US007511406B2

(12) United States Patent
Wyner et al.

(10) Patent No.: US 7,511,406 B2
(45) Date of Patent: Mar. 31, 2009

(54) METAL HALIDE ARC DISCHARGE LAMP

(75) Inventors: Elliot Wyner, Peabody, MA (US); Mary Berger, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 315 days.

(21) Appl. No.: 11/450,678

(22) Filed: Jun. 10, 2006

(65) Prior Publication Data

US 2007/0103070 A1 May 10, 2007

Related U.S. Application Data

(60) Provisional application No. 60/735,233, filed on Nov. 9, 2005.

(51) Int. Cl.
*H01J 5/02* (2006.01)
*H01J 61/32* (2006.01)

(52) U.S. Cl. ..... 313/25; 313/634; 313/573

(58) Field of Classification Search ..... 313/570, 313/573, 634, 638

See application file for complete search history.

(56) References Cited

U.S. PATENT DOCUMENTS

| | | | | |
|---|---|---|---|---|
| 4,281,274 | A | 7/1981 | Bechard et al. | 315/49 |
| 4,499,396 | A | 2/1985 | Fohl et al. | 313/25 |
| 4,580,989 | A | 4/1986 | Fohl et al. | 445/26 |
| 4,888,517 | A | 12/1989 | Keeffe et al. | 313/25 |
| 5,122,706 | A | 6/1992 | Parrott et al. | 313/25 |
| 5,729,078 | A * | 3/1998 | Pragt | 313/25 |
| 6,492,764 | B2 * | 12/2002 | Takeda et al. | 313/25 |
| 6,741,013 | B2 * | 5/2004 | Dakin et al. | 313/25 |
| 2002/0021093 | A1 * | 2/2002 | Kakisaka et al. | 313/634 |
| 2003/0141818 | A1 * | 7/2003 | Kelly | 313/638 |
| 2006/0049765 | A1 * | 3/2006 | Ota et al. | 313/638 |

* cited by examiner

*Primary Examiner*—Ashok Patel
(74) *Attorney, Agent, or Firm*—William E. Meyer

(57) ABSTRACT

A metal halide arc discharge lamp (10) having a lamp envelope (12) and an arc tube (14) mounted within the envelope; a shroud (20) surrounding the arc tube (14); electrical lead-ins (26, 28) for supplying electrical energy to the arc tube (14); and a chemical fill within the arc tube to produce light when an arc is formed within the arc tube; the improvement comprising: the shroud (20) having a given thickness T and a given inside diameter ID having a relationship such that T is less than 2 mm and ID/T is less than 22.

4 Claims, 3 Drawing Sheets

METAL HALIDE ARC DISCHARGE LAMP

CROSS-REFERENCE TO RELATED APPLICATION

This application claims priority from Provisional Patent Application Ser. No. 60/735,233, filed Nov. 9, 2005.

TECHNICAL FIELD

This invention relates to metal halide arc discharge lamps and more particularly to such lamps utilizing shrouds. More particularly, it relates to such lamps having shrouds that provide increased containment in the event of a non-passive failure of the arc tube.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud that comprises a generally cylindrical, light-transmissive member, such as quartz, that is able to withstand high operating temperatures. The arc tube and the shroud are coaxially mounted within the lamp envelope with the arc tube located within the shroud. Preferably, the shroud is a tube that is open at both ends. In other cases, the shroud is open on one end and has a domed configuration on the other end. Shrouds for metal halide arc discharge lamps are disclosed in U.S. Pat. No. 4,499,396 issued Feb. 12, 1985 to Fohl et al.; U.S. Pat. No. 4,580,989 issued Apr. 8, 1986 to Fohl et al.; and U.S. Pat. No. 4,888,517 to Keeffe et al., issued Dec. 19, 1989. See also U.S. Pat. No. 4,281,274 issued Jul. 28, 1981 to Bechard et al. U.S. Pat. No. 5,122,706 to Parrott et al. teaches that containment can be enhanced if the OD of the arc tube is less than 3 mm from the ID of the shroud.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. Finally, the shroud improves the safety of the lamp by acting as a containment device in the event that the arc tube shatters; however, it has been discovered that, upon a non-passive failure of an arc tube, the shards therefrom can fracture the shroud and the shards from the shroud may be the culprit that has the capability of fracturing the outer envelope, the actual condition that the shroud was supposed to prevent.

DISCLOSURE OF INVENTION

It is, therefore, an object of the invention to obviate the disadvantages of the prior art.

It is another object of the invention to reduce the cost of metal halide arc discharge lamps.

These objects are accomplished, in one aspect of the invention by the provision of a metal halide arc discharge lamp having a lamp envelope and an arc tube mounted within said envelope; a shroud surrounding said arc tube; electrical lead-ins for supplying electrical energy to said arc tube; and a chemical fill within said arc tube to produce light when an arc is formed within said arc tube; the improvement comprising: said shroud having a given thickness T and a given inside diameter ID having a relationship such that T is less than 2 mm and ID/T is less than 22.

The thinner shroud reduces the kinetic energy of shroud shards in the event of a non-passive failure of an arc tube and that thinner wall thickness, together with the reduced ID, reduces the total mass of the shroud and reduces cost even though the distance between the OD of the arc tube and the ID of shroud has increased over that thought desirable by Parrot et al. '517.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
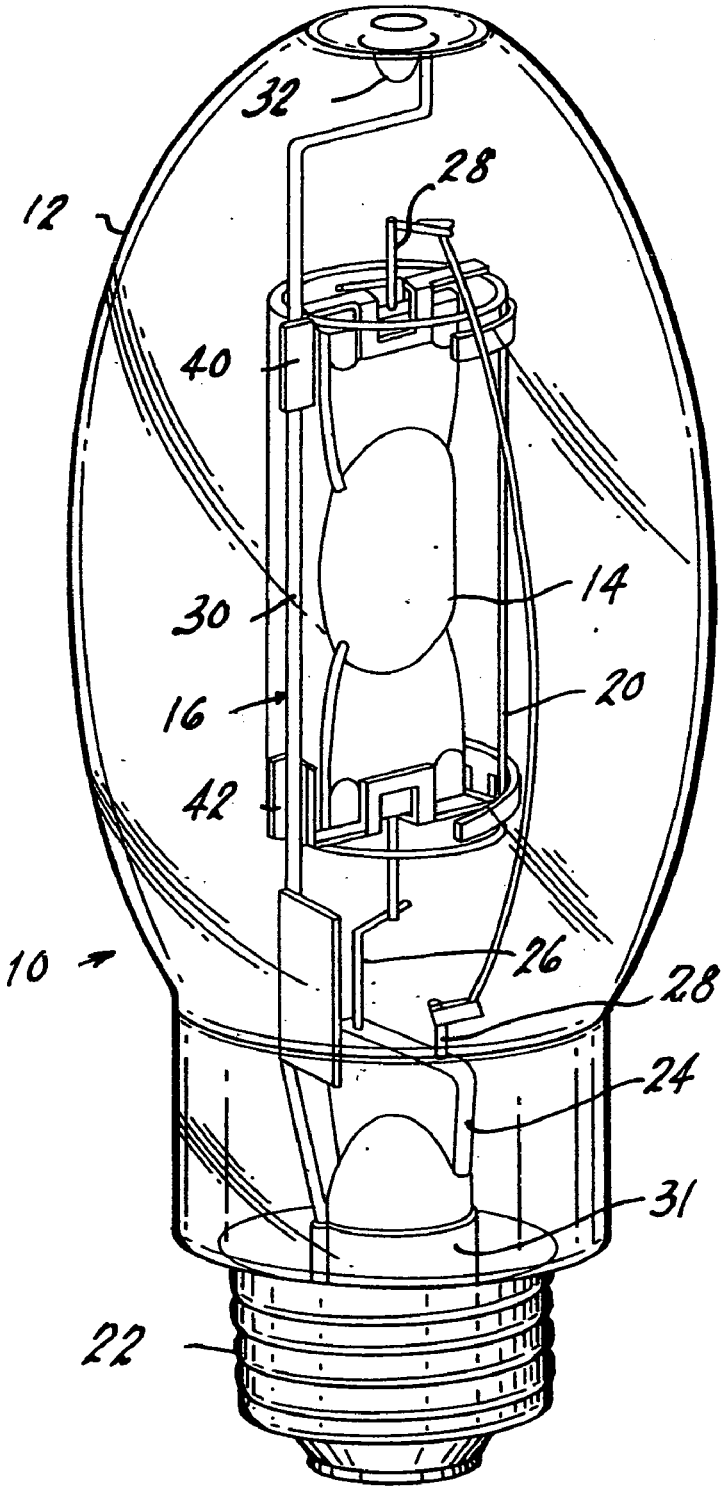
FIG. 1 is a perspective view of a metal halide discharge lamp employing the invention.
Figure 2:
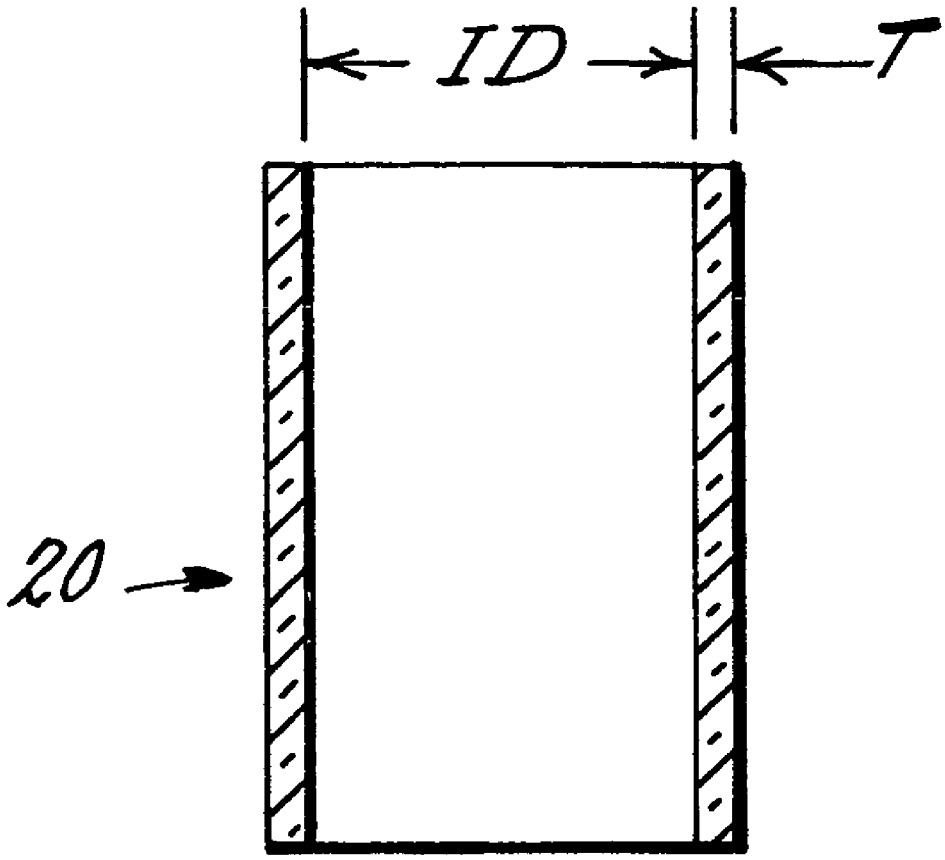
FIG. 2 is a sectional view of an arc tube shroud in accordance with an aspect of the invention.

Referring now to the drawings with greater particularity, there is shown in FIG. 1 a first exemplary metal halide arc discharge lamp 10 including a lamp envelope 12 and an arc tube 14 mounted within the envelope by mounting frame 16. The arc tube is positioned within a shroud 20 which can also be supported by the mounting frame 16. Electrical energy is coupled to the arc tube 14 through a base 22, a lamp stem 24 and electrical leads 26 and 28. The arc tube contains a chemical fill or dose of materials to provide light when an arc is initiated therein, as is known. The shroud 20 comprises a cylindrical tube of light transmissive, heat resistant material such as quartz. While, as noted above, the shroud has many functions, its primary function is containment of arc tube shards in the unlikely event of a non-passive arc tube failure.

As noted, in this particular instance, a mounting frame 16 supports both the arc tube 14 and the shroud 20 within the lamp envelope 12. The mounting frame 16 includes a metal support rod 30 attached to lamp stem 24 by a strap 31. The support rod engages an inward projection 32 in the upper end of the lamp envelope 12. The support rod 30 in its central portion is parallel to a central axis of the arc tube 14 and shroud 20. The mounting means 16 further includes an upper clip 40 and a lower clip 42, which secure both arc tube 14 and shroud 20 to support rod 30. The clips 40 and 42 are attached to the support rod 30, preferably by welding.

The use of the shroud 20 has proven successful in most instances of non-passive arc tube failure in containing the shards from an arc tube burst; however, it has also been discovered that frequently the shards emanating from a broken shroud can fracture the outer envelope, this being the very condition the shroud was supposed to protect.

It has been discovered that the latter problem can be eliminated and the cost of the shroud substantially reduced by controlling the thickness of the shroud wall (T) and the inside diameter (ID) such that T<2 and ID/T is less than 22.

In a specific embodiment for a 400 watt protected lamp these conditions can be met by a shroud of quartz having a wall thickness of 1.5 mm and an ID of 32 mm yielding ID/T of 21.33.

Figure 3:
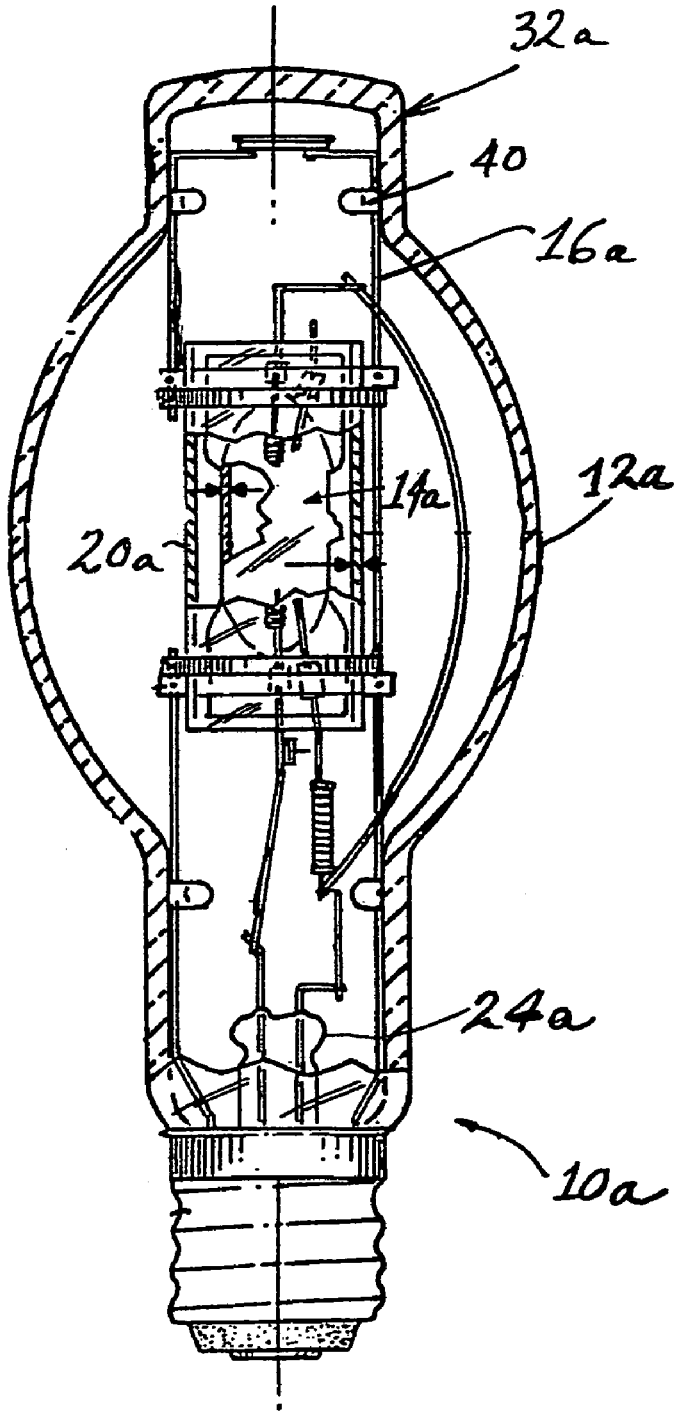
FIG. 3 is a sectional view of an alternate embodiment of a metal halide discharge lamp employing the invention.

The invention is applicable to other forms of metal halide lamps, such as that shown in FIG. 3, wherein a lamp 10*a* has an envelope 12*a* with an arc tube 14*a* mounted with a shroud 20*a*. The arc tube 10*a* has a thick outer wall as described in U.S. Pat. No. 4,888,517. The envelope 12*a* has a dome 32*a* into which snubbers 40 on frame 16*a* are inserted to mount the arc tube and shroud assembly.

Utilization of this invention reduces cost by shrinking the shroud, reducing the material cost and resulting in lower expenses when cutting the shrouds from tubing. Further, it has been found that increasing the distance between the arc tube OD and the shroud ID to greater than 3 mm, as taught by the above-cited Parrot patent, still passes containment testing and eases the assembly of the arc tube within the shroud by increasing the tolerances for the tip-off, etc.

While there have been shown and described what are present considered to be the preferred embodiments of the invention, it will be apparent to those skilled in the art that various changes and modifications can be made herein without departing from the scope of the invention as defined by the appended claims.

What is claimed is:

1. In a 400 watt metal halide arc discharge lamp having a lamp envelope subject to failure upon impaction from glass shards having a given mass; an arc tube mounted within said envelope, said arc tube having an outside diameter OD;

a shard-producing shroud surrounding said arc tube;

electrical lead-ins for supplying electrical energy to said arc tube; and a chemical fill within said arc tube to produce light when an arc is formed within said arc tube; the improvement comprising:

said shroud having a given thickness T equal to 1.5 mm and a given inside diameter ID, said ID of said shroud being greater than said OD of said arc tube by at least 3 mm and having a relationship such that ID/T is less than 22, whereby any shards produced by said shroud in the event of a non-passive arc tube burst have a mass less than said given mass.

2. The metal halide arc discharge lamp of claim 1 wherein said arc tube and said shroud are mounted within said envelope by a common frame.

3. The metal halide arc discharge lamp of claim 2 wherein said shroud is quartz.

4. The metal halide arc discharge lamp of claim 3 wherein said shroud ID is 32 mm.

* * * * *